US007647845B2

(12) United States Patent
Hiesinger

(10) Patent No.: US 7,647,845 B2
(45) Date of Patent: Jan. 19, 2010

(54) METHOD AND DEVICE FOR DETERMINING THE WEB TENSION OR THE WEB TENSILE FORCE IN A PRINTING SUBSTRATE WEB

(75) Inventor: Wolfgang Hiesinger, Biberbach (DE)

(73) Assignee: MAN Roland Druckmaschinen AG, Augsburg (DE)

( * ) Notice: Subject to any disclaimer, the term of this patent is extended or adjusted under 35 U.S.C. 154(b) by 0 days.

(21) Appl. No.: 12/058,372

(22) Filed: Mar. 28, 2008

(65) Prior Publication Data

US 2008/0236299 A1 Oct. 2, 2008

(30) Foreign Application Priority Data

Mar. 30, 2007 (DE) ..... 10 2007 015 785

(51) Int. Cl.
*G01L 5/04* (2006.01)

(52) U.S. Cl. ..... 73/862.391

(58) Field of Classification Search ..... 73/159, 73/862.391
See application file for complete search history.

(56) References Cited

U.S. PATENT DOCUMENTS 3,701,493 A * 10/1972 Welsch et al. ..... 242/413.2
3,905,533 A * 9/1975 Corse ..... 226/44
5,039,374 A * 8/1991 Winter ..... 156/504
5,182,722 A * 1/1993 Hain ..... 700/223
5,357,178 A * 10/1994 Kapitan ..... 318/7
5,813,277 A * 9/1998 Schmidt et al. ..... 73/159
6,122,978 A * 9/2000 Callendrier ..... 73/862.474
6,250,146 B1 * 6/2001 Callendrier ..... 73/159
6,578,479 B2 * 6/2003 Schramm ..... 101/219

(Continued)

FOREIGN PATENT DOCUMENTS

DE 35 90 509 C2 10/1986

(Continued)

OTHER PUBLICATIONS

Valenzuela, M. Anibal, "Sensorless Tension Control in Paper Machines", IEEE Transactions on Industry Applications, vol. 39, No. 2, Mar./Apr. 2003, pp. 294-304.

(Continued)

*Primary Examiner*—Lisa M Caputo
*Assistant Examiner*—Freddie Kirkland, III
(74) *Attorney, Agent, or Firm*—Crowell & Moring LLP

(57) ABSTRACT

A device and method for determining the web tension or the web tensile force in a printing substrate web is disclosed. A device is arranged at a first position along a transport path of the printing substrate web, which device supplies a signal to deduce the web tension in effect at the first position or the web tensile force in effect at the first position. A device arithmetically determines the web tension in effect or the web tensile force in effect at the second position from the web tension in effect at the first position or from the web tensile force in effect at the first position as well as from forces, which at least one driven roller and/or at least one trailing roller, which is/are arranged along the transport path of the printing substrate web between the first position and the second position, introduce to the printing substrate web.

20 Claims, 1 Drawing Sheet

U.S. PATENT DOCUMENTS

| | | | | |
|---|---|---|---|---|
| 6,752,013 | B2 * | 6/2004 | Cote et al. | 73/159 |
| 6,763,749 | B2 * | 7/2004 | Droste et al. | 83/37 |
| 6,985,789 | B2 * | 1/2006 | Carlson et al. | 700/122 |
| 6,991,144 | B2 * | 1/2006 | Franz et al. | 226/24 |
| 6,993,964 | B2 * | 2/2006 | Franz et al. | 73/159 |
| 2002/0008173 | A1 * | 1/2002 | Burri et al. | 242/420.6 |
| 2002/0062689 | A1 * | 5/2002 | Cote et al. | 73/159 |
| 2005/0137738 | A1 | 6/2005 | Carlson et al. | |
| 2005/0166670 | A1 * | 8/2005 | Franz et al. | 73/159 |
| 2007/0131036 | A1 * | 6/2007 | Schultze | 73/862.391 |

FOREIGN PATENT DOCUMENTS

| | | | |
|---|---|---|---|
| DE | 199 42 031 | A1 | 3/2001 |
| DE | 100 27 471 | A1 | 8/2001 |
| DE | 101 55 039 | A1 | 11/2002 |
| DE | 10 2005 028 333 | A1 | 12/2006 |
| DE | 10 2005 058 810 | A1 | 6/2007 |

OTHER PUBLICATIONS

Carrasco, R., et al., "Tension control of a two drum winder using paper tension estimation", Pulp and Paper Industry Technical Conference, 2005, pp. 170-178.

* cited by examiner

METHOD AND DEVICE FOR DETERMINING THE WEB TENSION OR THE WEB TENSILE FORCE IN A PRINTING SUBSTRATE WEB

This application claims the priority of German Patent Document No. 10 2007 015 785.3, filed Mar. 30, 2007, the disclosure of which is expressly incorporated by reference herein.

BACKGROUND AND SUMMARY OF THE INVENTION

The invention relates to a method for determining the web tension or the web tensile force in a printing substrate web. In addition, the invention relates to a device for determining web tension or the web tensile force in a printing substrate web.

In web-fed rotary printing presses, a to-be-printed printing substrate web is normally drawn off by a printing substrate roller that is held in readiness in the area of a reel changer, transported through printing couples for printing and, after printing, conveyed to a folding unit for further processing. So-called drag rollers as well as so-called web guide rollers are used to transport the printing substrate web through the web-fed rotary printing press. Drag rollers are driven by drives that are assigned to the drag rollers. No drives are assigned to web guide rollers. In fact, web guide rollers are carried along by friction from the printing substrate web.

For proper operation of a web-fed rotary printing press it is necessary to know the web tension in effect in the printing substrate web or the web tensile force in effect in the printing substrate web at defined positions along the transport path of the printing substrate web through the web-fed rotary printing press. The web tensile force is a force, wherein a web tension is determined from the web tensile force when the web tensile force is divided by the width of the printing substrate web being webbed up.

In web-fed rotary printing presses known from practice, each position of the transport path of the printing substrate web, for which the web tension or the web tensile force must be determined, is assigned a device, which supplies a signal that makes it possible to deduce the web tension in effect at the respective position or the web tensile force in effect at the respective position. Consequently, it is necessary to determine the web tension or the web tensile force at a position downstream from a drag roller as well as at a position upstream from a drag roller, as viewed in the transport direction of the printing substrate, and therefore each of these two positions are assigned such a device and thus a measuring point. This is involved and expensive.

Starting herefrom, the present invention is based on the objective of creating a novel method and a novel device for determining the web tension or the web tensile force in a printing substrate web.

According to the invention, the web tension in effect at a second position along the transport path of the printing substrate web or the web tensile force in effect at the second position is determined arithmetically, namely from the web tension in effect at the first position or from the web tensile force in effect at the first position as well as from forces, which at least one driven roller and/or at least one trailing roller, which is/are arranged along the transport path of the printing substrate web between the first position and the second position, introduce to the printing substrate web.

The present invention provides for the first time that the web tension in effect at a position along a transport path of the printing substrate web or the web tensile force in effect at this position be determined arithmetically, and namely on the basis of the web tension in effect at another position along the transport path of the printing substrate web or the web tensile force in effect at the other position as well as on the basis of forces, which at least one driven roller and/or at least one trailing roller, which is/are arranged along the transport path between these two positions, introduce to the printing substrate web. This makes it possible to reduce the hardware-related expense and to determine the web tension and thus the web tensile force at positions along the transport path of the printing substrate web through a web-fed rotary printing press with lower expense and therefore more cost-effectively.

Preferred developments of the invention are yielded from the following description. Without being limited hereto, exemplary embodiments of the invention are explained in greater detail on the basis of the drawings.

DETAILED DESCRIPTION OF THE DRAWINGS

In the following, the prior art will be described initially referring to FIG. 1, and then the invention will be described in greater detail making reference to FIG. 2.

Figure 1:
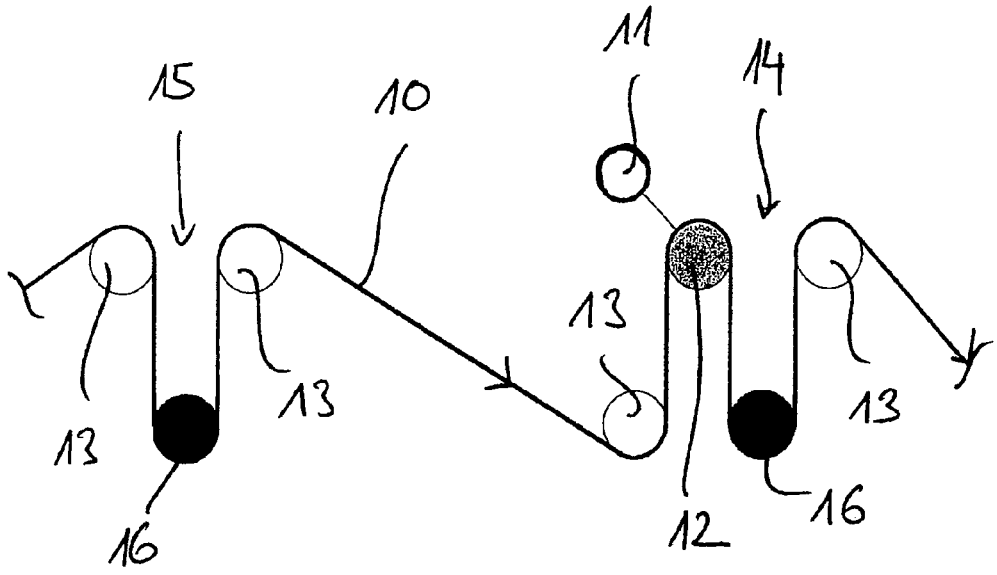
PRIOR ART Fig. 1
FIG. 1 illustrates an arrangement known from the prior art for determining the web tension or the web tensile force in a printing substrate web.

FIG. 1 shows a schematic section of a transport path of a printing substrate web 10 through a web-fed rotary printing press, whereby in the depicted section of the transport path a roller 12, which is driven by a drive 11 and also called a drag roller, is positioned. Depending upon the momentum applied by the drive 11, the drag roller 12 may have a conveying or braking effect and introduce corresponding forces to the printing substrate web 10.

According to FIG. 1, in addition to the driven drag roller 12, trailing rollers 13 are also arranged along the transport path of the printing substrate web 10, whereby the trailing rollers 13 are so-called web guide rollers. The web guide rollers 13 are driven in a carried-along fashion by friction from the printing substrate web 10 and also introduce the forces to the printing substrate web 10.

It is now important to determine the web tension in effect in the printing substrate web 10 or the web tensile force in effect in the printing substrate web 10 at a first position 14 along the transport path of the printing substrate web 10, which is arranged downstream from the drag roller 12 as viewed in transport direction of the printing substrate web, as well as at a second position 15 along the transport path of the printing substrate web 10, which is arranged upstream from the drag roller 12 as viewed in the transport direction of the printing substrate web 10. Thus, according to FIG. 1, a device 16 is arranged at each of these two positions 14 and 15, and each of these devices supplies a signal, which makes it possible to deduce the web tension in effect at the respective position 14, 15 or the web tensile force in effect at the respective position 14, 15. These devices 16 are measuring rollers in particular. Consequently, it follows from FIG. 1 that according to the prior art, every position of a transport path of the printing substrate web 10 for which the web tension or the web tensile force of the printing substrate web 10 must be known is assigned a device 16 and therefore a measuring point for recording measurements of the web tension or the web tensile force. This is involved and expensive.

Figure 2:
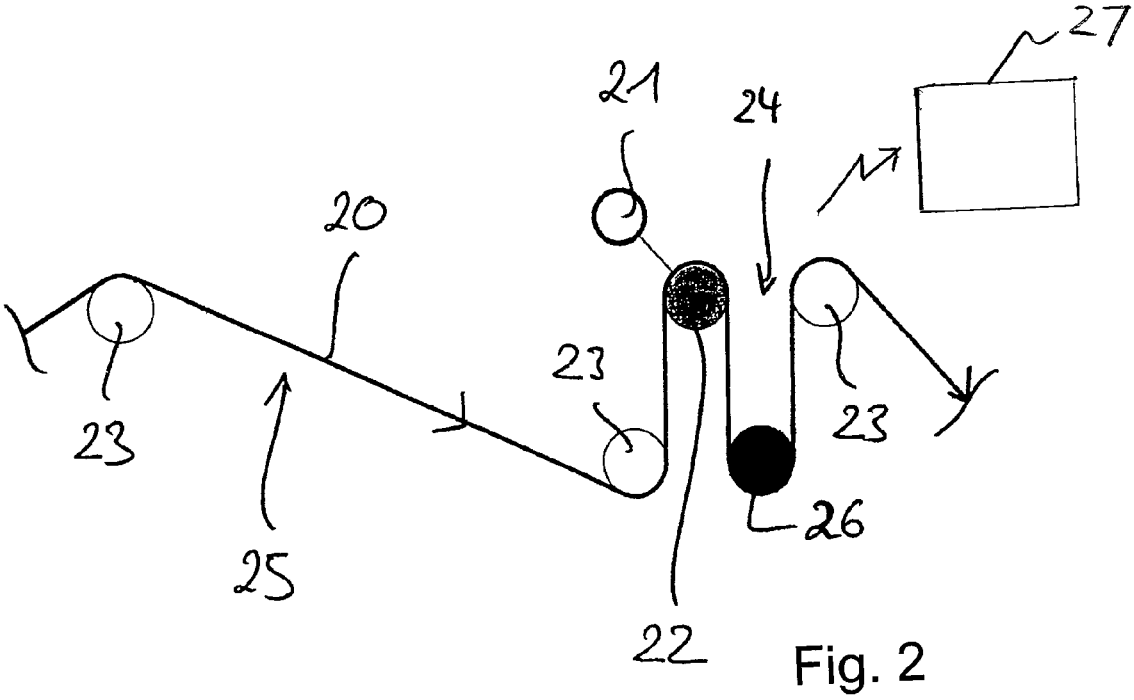
FIG. 2 illustrates an arrangement for determining the web tension or the web tensile force in a printing substrate web in accordance with the principles of the present invention.

FIG. 2 shows a section of a transport path of a printing substrate web 20 through a web-fed rotary printing press, whereby a roller 22 driven by a drive 21 is again arranged in the area of this section. The roller 22 is thus again a drag roller.

In addition to the drag roller 22, trailing rollers 23, which are carried along by friction from the printing substrate web 20, are arranged along the transport path of the printing substrate web 20. The rollers 23 are again web guide rollers.

Also in FIG. 2, the respective web tension or the respective web tensile force in effect in the printing substrate is supposed to be determined for the two positions 24, 25 along the transport path of the printing substrate web through the web-fed rotary printing press.

For this purpose, in FIG. 2 in accordance with the invention, exclusively one position, namely the first position 24 in FIG. 2 is assigned a device 26, which supplies a signal that makes it possible to deduce the web tension in effect at the first position 24 or the web tensile force in effect at this position 24. The device 26 is preferably a measuring roller. Alternatively, the device 26 can also be a dancing roller or a jockey roller.

The web tension in effect at the second position, namely at position 25, of the transport path or the web tensile force in effect at position 25 is determined arithmetically in accordance with the invention by a device 27 from the web tension in effect at the first position 24 or from the web tensile force in effect at the position 24 as well as from the forces, which the rollers 22, 23, which are arranged along the transport path of the printing substrate web between the two positions 24 and 25, introduce to the printing substrate web. Device 27 receives inputs related to these parameters from the various rollers/drive(s) themselves or devices associated with the rollers/drives.

According to FIG. 2, two rollers are arranged between the two positions 24 and 25, namely the driven roller 22 as well as a carried-along roller 23.

In the exemplary embodiment depicted in FIG. 2, position 25, for which the web tension or the web tensile force is being determined arithmetically, is arranged upstream (as viewed in the transport direction of the printing substrate web 20) from position 24, for which the web tension or the web tensile force is determined with the aid of the device 26. In contrast to this, it is also possible, however, for the position, for which the web tension or the web tensile force is being determined arithmetically, to be arranged downstream (as viewed in the transport direction of the printing substrate web) from the position for which the web tension or the web tensile force is being determined with the aid of a device that records measurements. Likewise, it is possible in contrast to the exemplary embodiment in FIG. 2 for more than two rollers to be positioned between the two positions 24, 25.

As already stated, the web tension or the web tensile force is determined arithmetically for the position 25, and namely taking into consideration the web tension or the web tensile force determined by recording measurements at position 24 with the aid the device 26 as well as on the basis of the forces, which the rollers 22, 23 arranged between the two positions 24, 25 introduce to the printing substrate web 20.

The force introduced to the printing substrate web 20 from a driven roller or drag roller 22 can be detected via the power consumption of the drive 21 of the drag roller 22. Thus, the power consumption of the drive 21 is proportional to the torque on the drag roller 22 and thus proportional to the force introduced by the drag roller 22 to the printing substrate web 20. Consequently, the force introduced by the drag roller 22 to the printing substrate web 20 can be derived from the power consumption of the drive 21, the characteristic data of the drive 21, the drive transmission between the drive 21 and the drag roller 22 as well as the diameter of the drag roller 22. In this case, the drag roller's 22 own torque requirement, which is produced by bearing friction and any coupling losses, is taken into consideration. This torque requirement of the drag roller can be determined initially either arithmetically or by recording measurements.

The forces introduced by the trailing web guide rollers 23 to the printing substrate web 20 are in particular forces caused by the web guide rollers' own torque requirement, which is produced in particular by the bearing friction of the web guide rollers. Even these forces can be determined initially arithmetically or by recording measurements.

In order to increase the accuracy in determining the web tension or the web tensile force in accordance with the invention, mass moments of inertia of the rollers 22, 23 can also be taken into consideration. These mass moments of inertia then play a role if a drag roller 22 is braked or accelerated. In the case of stationary operation with a uniformly driven drag roller 22, mass moments of inertia play a subordinate role, however.

Thus, it is within the scope of the present invention to cut down on measuring points for recording measurements and thus the hardware-related detection of the web tension or the web tensile force at defined positions along the transport path of a printing substrate web through a web-fed rotary printing press and to arithmetically determine the web tension or the web tensile force for these positions for which there are no measuring points by taking the measuring results of other positions into consideration.

LIST OF REFERENCE NUMERALS

10 Printing substrate web
11 Drive
12 Roller/drag roller
13 Roller/web guide roller
14 Position
15 Position
16 Device/measuring roller
20 Printing substrate web
21 Drive
22 Roller/drag roller
23 Roller/web guide roller
24 Position
25 Position
26 Device/measuring roller
27 Device The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for determining web tension or web tensile force in a printing substrate web, wherein a device is arranged at a first position along a transport path of the printing substrate web, wherein the device supplies a signal, which makes it possible to deduce the web tension in effect at the first position or the web tensile force in effect at the first position, wherein the web tension in effect at a second position along the transport path of the printing substrate web or the web tensile force in effect at the second position is determined arithmetically, namely from the web tension in effect at the first position or from the web tensile force in effect at the first position as well as from forces, which at least one driven roller and/or at least one trailing roller, which is/are arranged along the transport path of the printing substrate web between the first position and the second position, introduce to the printing substrate web.

2. The method according to claim 1, wherein the second position is arranged downstream from the first position as viewed in the transport direction of the printing substrate.

3. The method according to claim 1, wherein the second position is arranged upstream from the first position as viewed in the transport direction of the printing substrate.

4. The method according to claim 1, wherein the at least one driven roller is embodied as a drag roller, wherein the at least one trailing roller is embodied as a web guide roller, and wherein the drag roller and the web guide roller are positioned between the first position and the second position.

5. The method according to claim 1, wherein the device arranged at the first position, whose signal makes it possible to deduce the web tension in effect at the first position or the web tensile force in effect at the first position, is embodied as a measuring roller.

6. The method according to claim 1, wherein the device arranged at the first position, whose signal makes it possible to deduce the web tension in effect at the first position or the web tensile force in effect at the first position, is embodied as a dancing roller.

7. The method according to claim 1, wherein the device arranged at the first position, whose signal makes it possible to deduce the web tension in effect at the first position or the web tensile force in effect at the first position, is embodied as a jockey roller.

8. A device for determining web tension in a printing substrate web or web tensile force in a printing substrate web, wherein a measurement device is arranged at a first position along a transport path of the printing substrate web, wherein the measurement device supplies a signal, which makes it possible to deduce the web tension in effect at the first position or the web tensile force in effect at the first position, wherein the device, which arithmetically determines the web tension in effect at a second position along the transport path of the printing substrate web or the web tensile force in effect at the second position, namely from the web tension in effect at the first position or from the web tensile force in effect at the first position as well as from forces, which at least one driven roller and/or at least one trailing roller, which is/are arranged along the transport path of the printing substrate web between the first position and the second position, introduce to the printing substrate web.

9. The device according to claim 8, wherein the second position is arranged downstream from the first position as viewed in the transport direction of the printing substrate.

10. The device according to claim 8, wherein the second position is arranged upstream from the first position as viewed in the transport direction of the printing substrate.

11. The device according to claim 8, wherein the at least one driven roller is embodied as a drag roller, wherein the at least one trailing roller is embodied as a web guide roller, and wherein the drag roller and the web guide roller are positioned between the first position and the second position.

12. The device according to claim 8, wherein the measurement device arranged at the first position, whose signal makes it possible to deduce the web tension in effect at the first position or the web tensile force in effect at the first position, is embodied as a measuring roller.

13. The device according to claim 8, wherein the measurement device arranged at the first position, whose signal makes it possible to deduce the web tension in effect at the first position or the web tensile force in effect at the first position, is embodied as a dancing roller.

14. The device according to claim 8, wherein the measurement device arranged at the first position, whose signal makes it possible to deduce the web tension in effect at the first position or the web tensile force in effect at the first position, is embodied as a jockey roller.

15. A method for determining a web tension or a web tensile force in a printing substrate web, comprising the steps of:

determining the web tension or the web tensile force at a first position along a transport path of the printing substrate web by a measurement device; and arithmetically determining the web tension or the web tensile force at a second position along the transport path of the printing substrate web by a device from the web tension or the web tensile force determined at the first position by the measurement device and from a force exerted on the printing substrate web by a driven roller and/or a trailing roller which is/are arranged along the transport path of the printing substrate web between the first position and the second position.

16. The method according to claim 15, wherein the device is not in contact with the printing substrate web at the second position.

17. The method according to claim 15, wherein the device does not sense the web tension or the web tensile force at the second position.

18. The method according to claim 15, further comprising the step of deriving the force exerted on the printing substrate web by the driven roller from a parameter associated with a drive that drives the driven roller.

19. The method according to claim 15, further comprising the step of deriving the force exerted on the printing substrate web by the trailing roller from a torque of the trailing roller.

20. The method according to claim 15, wherein the web tension or the web tensile force at the second position along the transport path of the printing substrate web is arithmetically determined additionally from a mass moment of inertia of the driven roller and/or the trailing roller.

* * * * *